US005474362A

United States Patent [19]

Albecker, III

[11] Patent Number: 5,474,362

[45] Date of Patent: Dec. 12, 1995

[54] CUSHIONS HAVING INTERNAL SUPPORT MEMBER

[76] Inventor: Walter J. Albecker, III, 838 S. May, Chicago, Ill. 60607

[21] Appl. No.: 197,223

[22] Filed: Feb. 16, 1994

Related U.S. Application Data

[63] Continuation-in-part of Ser. No. 721,179, Jun. 26, 1991, abandoned.

[51] Int. Cl.[6] ..... A47C 7/46

[52] U.S. Cl. ..... 297/452.32; 297/284.4; 297/452.3; 5/640

[58] Field of Search ..... 297/284.1, 284.3–284.5, 297/452.30, 452.31, 452.32, DIG. 1, 230.1, 230.14; 5/633, 640

[56] References Cited

U.S. PATENT DOCUMENTS

| | | | |
|---|---|---|---|
| 1,446,290 | 2/1923 | Dessau | 5/455 |
| 2,659,418 | 11/1953 | Berman . | |
| 3,193,328 | 7/1965 | Baermann | 297/456 |
| 3,270,393 | 9/1966 | Levenson | 297/DIG. 1 X |
| 3,751,111 | 8/1973 | Taylor et al. | 297/456 |
| 3,846,857 | 11/1974 | Weinstock | 5/345 |
| 3,948,558 | 4/1976 | Obermeier et al. | 297/284 |
| 3,987,507 | 10/1976 | Hall | 5/338 |
| 4,053,957 | 10/1977 | Regan | 5/355 |
| 4,086,675 | 5/1978 | Talbert et al. | 5/355 |
| 4,161,045 | 7/1979 | Regan | 5/464 |
| 4,190,697 | 2/1980 | Ahrens | 428/315 |
| 4,431,232 | 2/1984 | Hannouche | 297/460 |
| 4,522,447 | 6/1985 | Snyder et al. | 297/452 |
| 4,534,593 | 8/1985 | Ojala | 297/284 |
| 4,555,137 | 11/1985 | Goldner | 297/284.4 X |
| 4,592,588 | 6/1986 | Isono et al. | 297/284 |
| 4,601,514 | 7/1986 | Meiller | 297/284 |
| 4,634,179 | 1/1987 | Hashimoto | 297/284 |
| 4,725,095 | 2/1988 | Lyon et al. . | |
| 4,756,035 | 7/1988 | Beier | 5/540 |
| 4,810,034 | 3/1989 | Beier | 297/460 X |
| 4,834,455 | 5/1989 | Proctor | 297/353 |
| 4,835,801 | 6/1989 | Walpin et al. | 297/460 X |
| 4,856,844 | 8/1989 | Isono | 297/284 |
| 4,916,765 | 4/1990 | Castrovova, Jr. | 5/640 |

*Primary Examiner*—Peter R. Brown

[57] ABSTRACT

Cushions for chairs and the like, having a firm internal support member to support key parts of the user's body such as the lumbar region of the back. These cushions are comprised of: a relatively soft cushion material on the body contacting portion of the cushion, which may or may not be part of; an elastic polyurethane foam type cushion material having a generally tubular cavity or hollow of a predetermined size, shape, and location; and a generally firmer elastic polyurethane foam type internal support member strategically shaped and located in the cavity or hollow of the cushion mentioned above. The cushions are designed for maximum user comfort with the body contacting surface of the cushion being relatively soft, but at the same time the cushions for the back, support the lumbar region so that the user's spine will be in the proper position to minimize strain and discomfort. Essentially the cushions more evenly distribute the load of the person sitting on them in such a way that the back etc. is properly aligned to minimize strain and fatigue. The cushions can be made from slab stock polyurethane foam type materials, can be used with other materials, can be made in a wide variety of shapes and sizes, and can be used in a number of different seating applications. Also, a method of making the cushions is disclosed using an electric knife with the capability of piercing the cushion body to create the cavity mentioned above.

23 Claims, 11 Drawing Sheets

CUSHIONS HAVING INTERNAL SUPPORT MEMBER

This is a continuation-in-part of application Ser. No. 07/721,179, filed Jun. 26, 1991, abandoned.

BACKGROUND—FIELD OF INVENTION

This invention relates to cushions for seats and/or backrests, and specifically to such cushions which are designed to support the user in a way which naturally balances the work of sitting to minimize stress, strain, and fatigue to key parts of the user's body.

BACKGROUND—DISCUSSION OF PRIOR ART

The pursuit of making chairs more comfortable has taken two basic forms. One approach is to contour the body contacting surfaces of the chair to provide good support to critical parts of the user's body such as the lumbar region of the back. Though contouring is generally an effective solution, it can have the drawback of being relatively expensive to manufacture, and it may not be aesthetically appropriate for some styles of furniture, or people's tastes. Also, it is difficult to make a contoured cushion reversible.

The second approach deals with the inherent support of the cushion materials and internal support inserts. Many years ago, springs were used to provide support in cushions. More recently with the development of foam rubbers, a number of other approaches have been tried.

U.S. Pat. No. 2,659,418 discloses an invention to insert spiral plugs in cushions. Spiral plugs, however, are not shaped to provide optimal body support, and they are complicated to manufacture.

The use of specially designed cavities embedded in a cushion to enable the cushion to conform to the shape of the user's body is described in U.S. Pat. No. 3,193,328. Though an excellent solution, it does not provide clearly articulated lower lumbar support, and requires a relatively expensive method of manufacture involving molding two sections, and joining them.

There are also a number of inventions incorporating inflatable or solid moveable internal supports in cushions as in U.S. Pat. Nos. 4,592,588, 3,948,558, 4,807,931, 4,725,095, 4,856,844, and 4,834,455. The complexity of these makes them costly to manufacture. Though some of these are adjustable, study has shown that the distances from the seat to the lumbar do not change very substantially from one person to the next. Though there may be some advantages to adjustable lumbar supports, the benefits do not justify the cost for most situations.

Other inventions such as U.S. Pat. No. 4,534,593 call for the manufacture of a special lumbar support behind a cushion for existing seats in vehicles. This results in a cushion that is somewhat contoured from behind.

The solutions closest to the present invention would probably include those that use a firmer resilient foam next to or inside a cushion. Examples include U.S. Pat. Nos. 4,522,447, 4,161,045, 3,987,507, and 4,190,697. Though these are well conceived ideas, none offer the economy of being made from a simple slab of flexible foam.

U.S. Pat. No. 4,522,447 discloses an invention to provide good seat support through the use of different pieces of varying density cellular elastic material. It is an excellent idea, but from looking at the shapes of flexible foam used in it's construction, it appears that there would be a lot of wasted material. It also seems to require a firm flat support under the cushions to get the best effect. In addition to the cost of this support, it would limit the applications for which the cushion could be used, and would not be reversible. Though the invention discloses a backrest with a lumbar support, the lumbar support is contoured with the drawbacks mentioned for other contoured cushions above. This invention also does not suggest a way to be used with cushions using a loose fill cushioning material, in addition to just slab foam.

U.S. Pat. No. 3,751,111 discloses a variable density contour chair. Though the chair may provide some support, it involves a process where each chair is foamed in situ. This type of cushion is not made from economical slab foam. Another drawback that is pointed out in U.S. Pat. No. 4,522,447 is that when a variable density cushion is made by pouring polyurethane foam around a preformed foam block, a chemical reaction takes place which causes a hard skin to form around the preformed block.

U.S. Pat. No. 4,161,045 discloses a mattress with a number of ribs that are less compressible than the rest of the mattress. These ribs are positioned to support only the shoulders and buttocks of the one lying on the mattress. In addition to being complicated and costly to produce, it proposes giving less support to the lumbar region of the back, and more to the shoulders and buttocks. It also is not designed for chair cushions.

U.S. Pat. No. 4,190,697 describes a multidensity foam article, specifically a seat cushion with a high density base. The cushion has the following drawbacks, first it has to be made one at a time as opposed to from slab foam stock. There is not a lot of flexibility in the shape that the higher density foam can be made in, which minimizes the chance for using the method for a cushion with an effective lumbar support. It also does not have the possibility for use with a loose fill cushion.

U.S. Pat. No. 3,987,507 discloses a pressure distribution pad for wheelchairs. This pad requires three layers of cushion material with the center cushion having holes filled in with a different density foam. This solution is designed for wheelchair seats, and is not suited for lumbar support, because the holes and method cannot be used for a contoured internal support member. This invention is also not suitable for use with a loose fill cushion.

Because there is no really good solution for making most sofas and chairs supportive, most sofas and chairs sold do not have any more than plain cushions—with little lumbar or buttocks and thigh support.

OBJECTS AND ADVANTAGES

Accordingly, several objects and advantages of my invention are:

(a) To provide cushions, in many common shapes and sizes, with an internal support member, that will work in conjunction with the primary cushion material to support the user's body.

(b) To provide cushions that give good support to key areas of the user's body, but without the support having to alter the cushion aesthetically. This means that although the invention is for both contoured and non-contoured cushions, it is not necessary to contour or alter the design or shape of the cushion to achieve the desired effect.

(c) To provide an economical cushion with an internal support member that naturally balances the work of sitting to minimize stress, strain and fatigue to key parts of the user's body.

(d) To provide a way to make a wide variety of cushions ergonomically supportive.

(e) To provide cushions for chairs and the like with good support, that can be made reversible if desired.

(f) To provide an internal support member for cushions that are either removable, or fixed in place on chairs and the like.

(g) To provide good user body support to cushions with varying degrees of firmness. A soft cushion could be made supportive, and also a firm cushion could be made supportive.

(h) To provide both loose fill and solid flexible foam rubber cushions with good user body support.

(i) To provide cushions that can be very soft and comfortable, and yet provide very good support to the user's body.

(j) To provide a clearly defined lumbar support in backrest cushions.

(k) To provide balanced support to the thighs and buttocks in seat cushions.

(l) To provide a method for putting an insert in a cushion without forming a hard skin on the surface of the insert.

(m) To provide a simple and economical way to make cushions with internal support members that can be used both for solid flexible foam rubber cushions, and can also be used for cushions that have loose or fiber fill material as the front or body contacting layer of the cushion.

(n) To provide a way to produce cushions with an internal support member which can be made from economical slab polyurethane type foam and also can be done with minimal wasted material.

Still further objects and advantages will become apparent from a consideration of the ensuing description and drawings.

DESCRIPTION OF INVENTION

Figure 1:
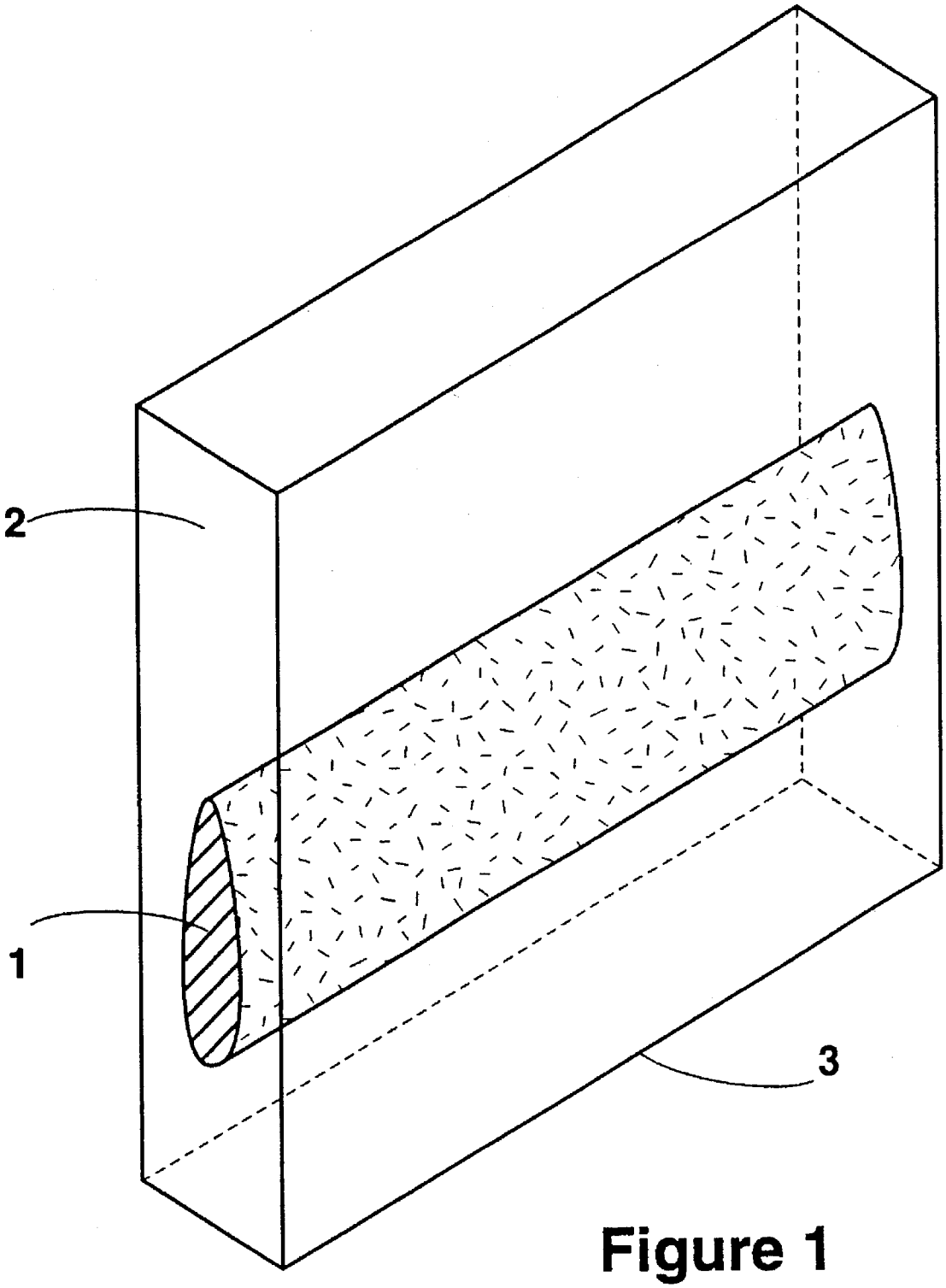
FIG. 1 is a perspective view of a typical embodiment of the present invention.

FIG. 1 shows a perspective view of a reversible backrest cushion embodying the present invention. In the drawing, a rectangular cushion body 2 is shown with an internal lumbar support member 1. The cushion material of 2 is made of a relatively soft, or low to medium firmness flexible polyurethane foam, and has an oval shaped cylindrical core removed. Each perspective view shows the cushions having a top, a bottom, a front (the body contacting surface 3 or for FIG. 3 it is 6), a back (the side opposite the body contacting surface), and two sides. These should be obvious when looking at FIGS. 1, 1A, 1B, 3A, 3B, and 3C. Likewise, each firm foam lumbar support has a top, a bottom, a front (the side facing the body contacting surface of the cushion body), a back, and two sides. Also, each would have a transverse center line, and substantially all (at least 70%) of the firm foam insert and corresponding channel shaped void would fall below the transverse center line. For the purposes of the claims, the term "channel shaped void" is a generic term that refers to both the horizontal tubular cavity referred to in FIGS. 1, 1A, 1B, 2, 2A, 2B, 2C,4, and 7, and it also refers to the generally semi-cylindrical hollow shown in FIGS. 3, 3A, 3B, and 3C. Removal of the cylindrical core results in a horizontal tubular cavity shaped like an oval cylinder, that was then filled with a firmer polyurethane foam oval cylinder 1 of the same size and shape. The face or body contacting surface of the cushion 3 is what the person seated in a chair or the like using the cushion, would put his or her back against. The tubular cavity and firm foam support member are shaped, sized and positioned to provide good support to the lumbar region of the user's body. Details on size, shape, and position of the cavity and support member are included under Operation of the Invention and Further Details.

Figure 1A:
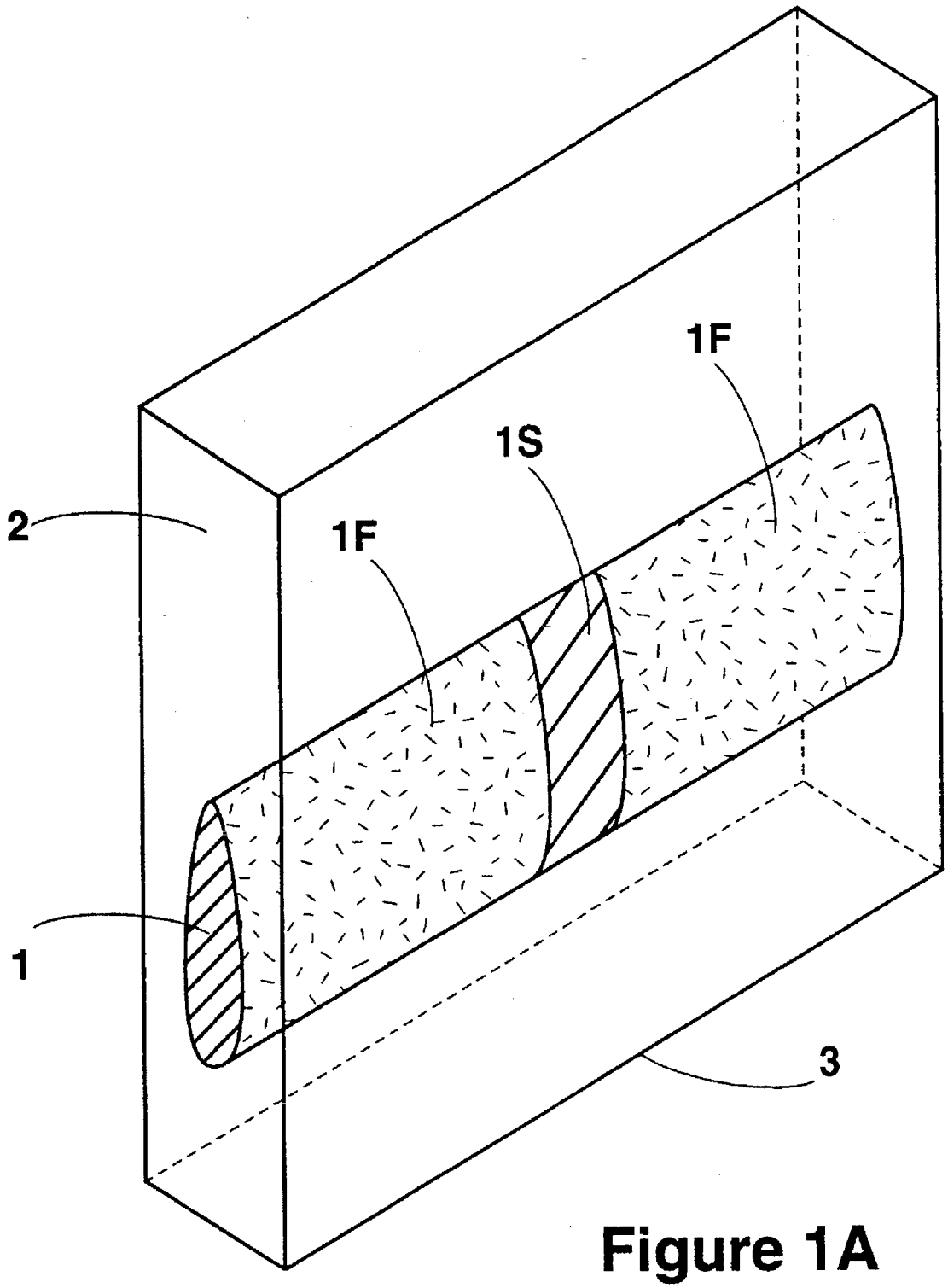
FIG. 1A is a perspective view of an embodiment similar to the one shown in FIG. 1, but with a softer foam material in the center portion of the firm foam lumbar support.

FIG. 1A shows a perspective view of a reversible backrest cushion similar to the cushion shown in FIG. 1, but with the internal lumbar support member 1A made with a relatively soft foam material in the center portion 1S. The relatively soft foam material in the center portion 1S surrounded by the firmer foam material on each side 1F is there to better distribute the weight of the user's back so that the spinal column will not be supporting the bulk of the weight near the lumbar region of the back. This enables the weight to be spread over a greater portion of the lumbar region of the back. This soft center portion 1S can be more comfortable on the spinal column. In a preferred embodiment, this center portion 1S is between about 2" and about 4", and is positioned to line up with the expected position of the spinal column of the occupant when sitting against the cushion. Reference to center portion is made with respect to the sides of the internal support member. This internal support member can be fabricated by using an adhesive to join foam blocks of appropriate sizes before cutting the large block formed (by the joining of the appropriate sized blocks into the block that will be cut) into the shape of the contoured cylinder. The firmness of the center portion 1S would be softer than the firmness of the outer portions 1F, and could even be softer than the main cushion body 2. In a preferred embodiment, the outer portions 1F has an ILD of between about 40 and 60 pounds, and the center portion 1S has an ILD of about 30 pounds. The firm insert 1A could also be formed using more than one layer of foam material in the center portion in a manner similar to that shown in FIG. 3B.

Figure 1B:
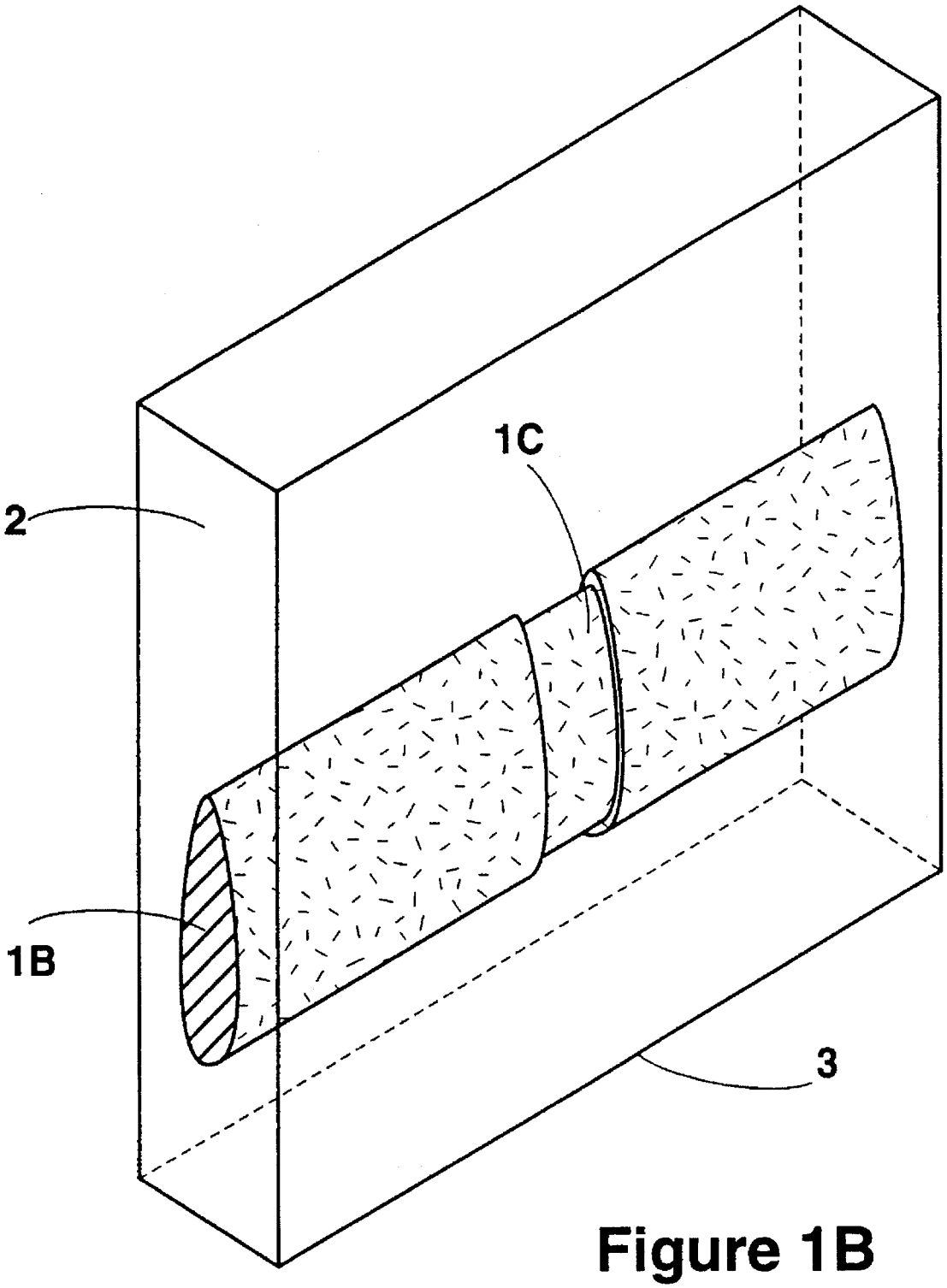
FIG. 1B is a perspective view of an embodiment similar to the one shown in FIG. 1, but with contouring to make the center portion of the firm foam lumbar support indented somewhat.

FIG. 1B shows a perspective view of a reversible backrest cushion similar to the cushion shown in FIG. 1, but with the internal lumbar support member 1B made with a firm foam support with two sides and a center portion with respect to said two sides, and with the center portion 1C contoured in a manner that causes it to be indented with respect to the rest of the firm foam support member. The hollow left in the center portion 1C enables the weight of the lumbar region of the user's back which is being supported to be distributed so that a disproportionate amount of pressure is not put on the spinal column. This hollow in the center portion 1C of the internal lumbar support 1B can enable the cushion to be more comfortable on the spinal column. In a preferred embodiment, this center portion 1C is between about 2" and about 4", and is positioned to line up with the expected position of the spinal column of the occupant when sitting against the cushion. Reference to center portion is made with respect to the sides of the internal support member. The hollow 1C formed on the firm lumbar support 1B can be left hollow or filled with a softer material such as a softer foam or dacron, etc. The firm insert 1B could also be contoured in a shape similar to that shown in FIG. 3C.

Figure 2:
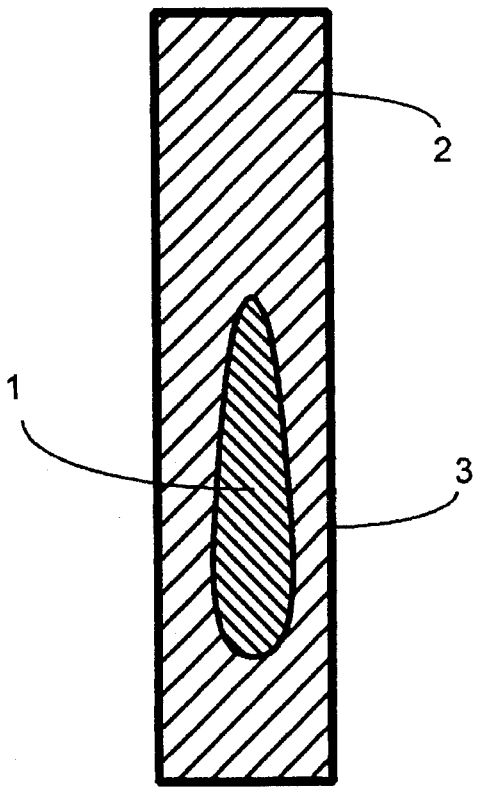
FIG. 2 is a side or cross section view of a reversible backrest cushion embodying the present invention.
Figure 2A:
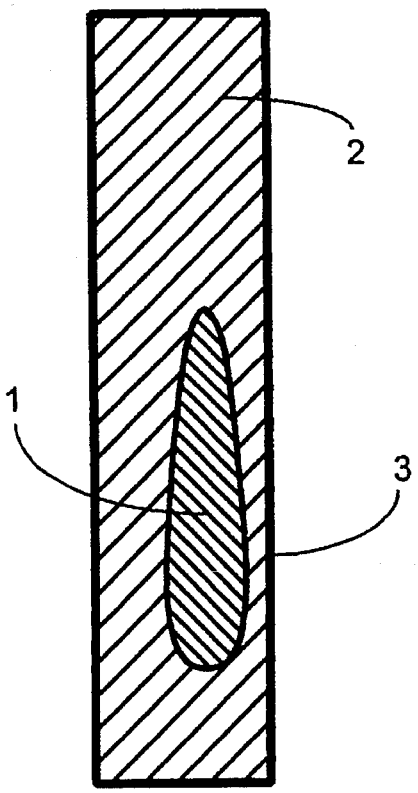
FIG. 2A is a side or cross section view of a variation of the embodiment shown in FIG. 2.
Figure 2B:
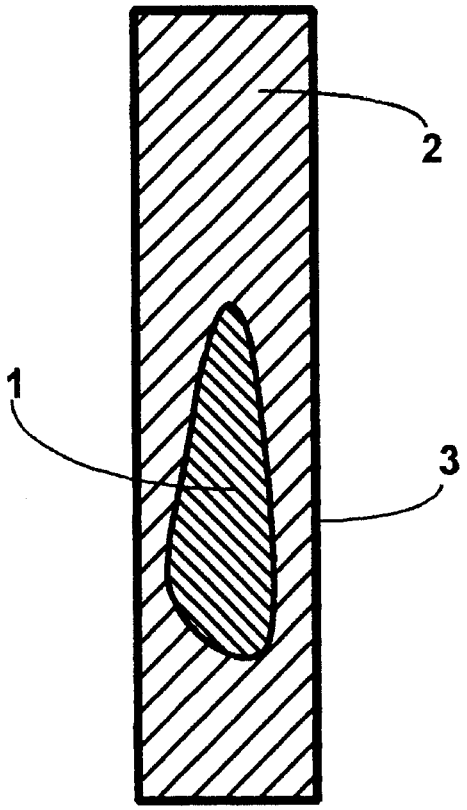
FIG. 2B is a side or cross section view of a variation of the embodiment shown in FIG. 2.

FIG. 2 shows a side or cross section view of the same cushion as FIG. 1. Again, 1 is the firmer foam lumbar support member, 2 is the low to medium firmness cushion body, and 3 is the face or body contacting surface of the cushion. This cushion is for use on chairs and the like that are designed with removable and reversible cushions, but can also be used with chairs and the like with fixed in place cushions. Though 3 is shown as the body contacting surface, it should be noted that if this were a reversible cushion, it would have two body contacting surfaces which are opposite one another. So 3 is a body contacting surface, and the side opposite 3 could also be a surface that contacts the user's body. This provides the opportunity to make a reversible cushion that can offer two different degrees of lumbar support. This could be achieved either by placing the lumbar support 1 closer to the body contacting surface 3, as shown in FIG. 2A or by making the lumbar support 1 extend further on one side instead of being symmetrical. The lumbar support 1 could be made more pronounced on the side of the body contacting surface 3, and less pronounced on the opposite side. One way of doing this would be to have the lumbar support member be a cylinder that is generally oval on the side toward 3, and generally elliptical on the side opposite 3 as shown in FIG. 2B. The result would be greater lumbar support when 3 is used as the body contacting surface, and less lumbar support when the side opposite 3 is used as the body contacting surface.

Figure 2C:
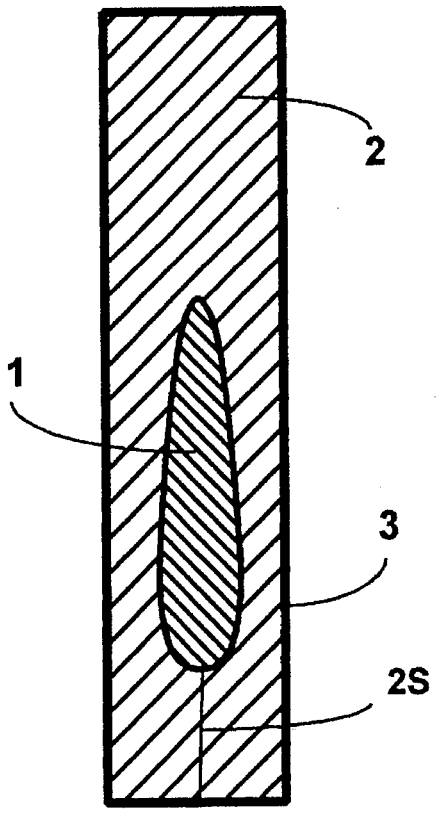
FIG. 2C is a side or cross section view of a variation of the embodiment shown in FIG. 2.

FIG. 2C is shows a side or cross section view of a cushion similar to the one shown in FIGS. 1 and 2, but with a slit 2S from the bottom of the cushion body to the generally tubular cavity. The slit enables the cavity in the cushion to be cut using cutting means and tools which are currently in use in the foam fabricating industry for cutting contours in foams. It is probably advisable to use adhesive in the slit after the firm foam lumbar support is installed.

Figure 3:
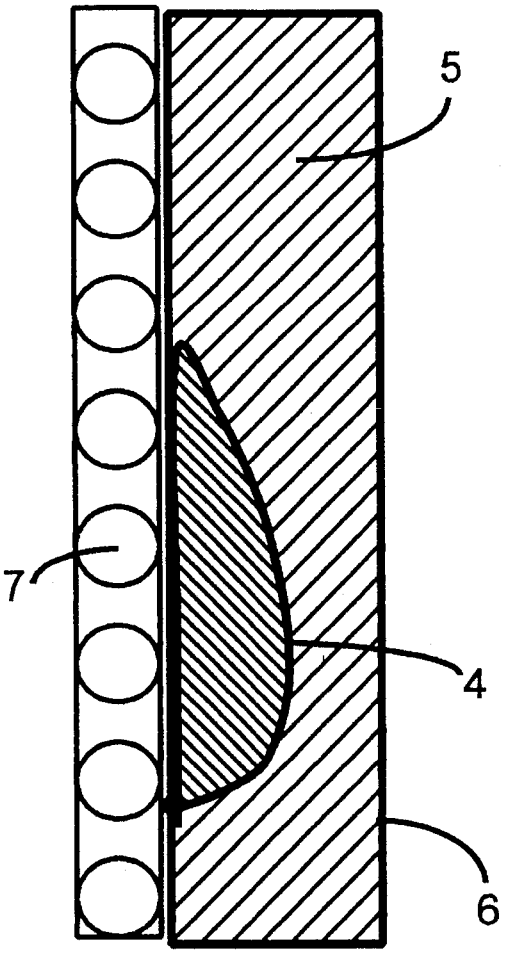
FIG. 3 is a side or cross section view of a fixed backrest cushion embodying the present invention.

FIG. 3 shows a side or cross section view of a typical fixed cushion embodying the present invention. This cushion is for chairs or the like where the cushions are usually not removable or reversible. In the drawing, 4 is a firm flexible polyurethane foam lumbar support member in a generally semi-cylindrical shape, 5 is a relatively soft or low to medium firmness flexible polyurethane foam cushion body, 6 is the face or body contacting surface of the cushion, and 7 is the back or base that the cushion is mounted against. This back or base could be made of springs, fabric, metal, plywood, etc. The cushion body 5 has had a horizontal, generally semi-cylindrical hollow made in it on the side opposite the body contacting surface. The semi-cylindrical hollow is sized, shaped, and positioned to provide greater support to the lumbar region of a user's spine, when filled with the firm support member 4. The hollow is contoured to be a generally round, oval, elliptical, teardrop shaped, or other shaped, semi-cylinder.

Figure 3A:
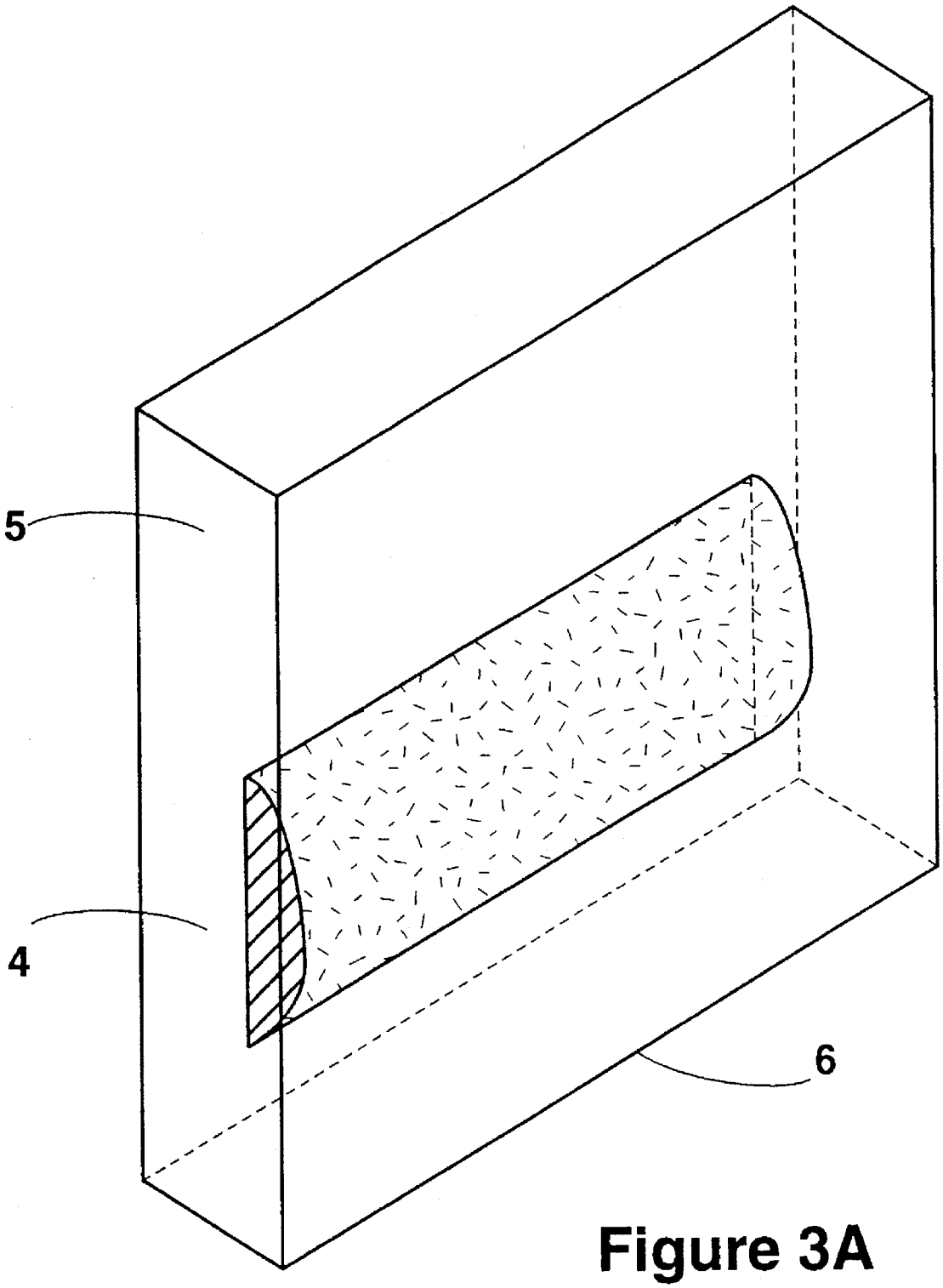
FIG. 3A is a perspective view of an embodiment similar to the one shown in FIG. 3, but showing the firm foam lumbar support not going the full width of the cushion body.

FIG. 3A is a perspective view of an embodiment similar to the one shown in FIG. 3, but showing the firm foam lumbar support not going the full width of the cushion body. This can be done to save on the cost of the firm insert, and also to provide softer edges on the cushion. A preferred method of fabricating this hollow involves using a hot wire cutter on a frame that moves on a axis. Various other spinning cutters can also be used.

Figure 3B:
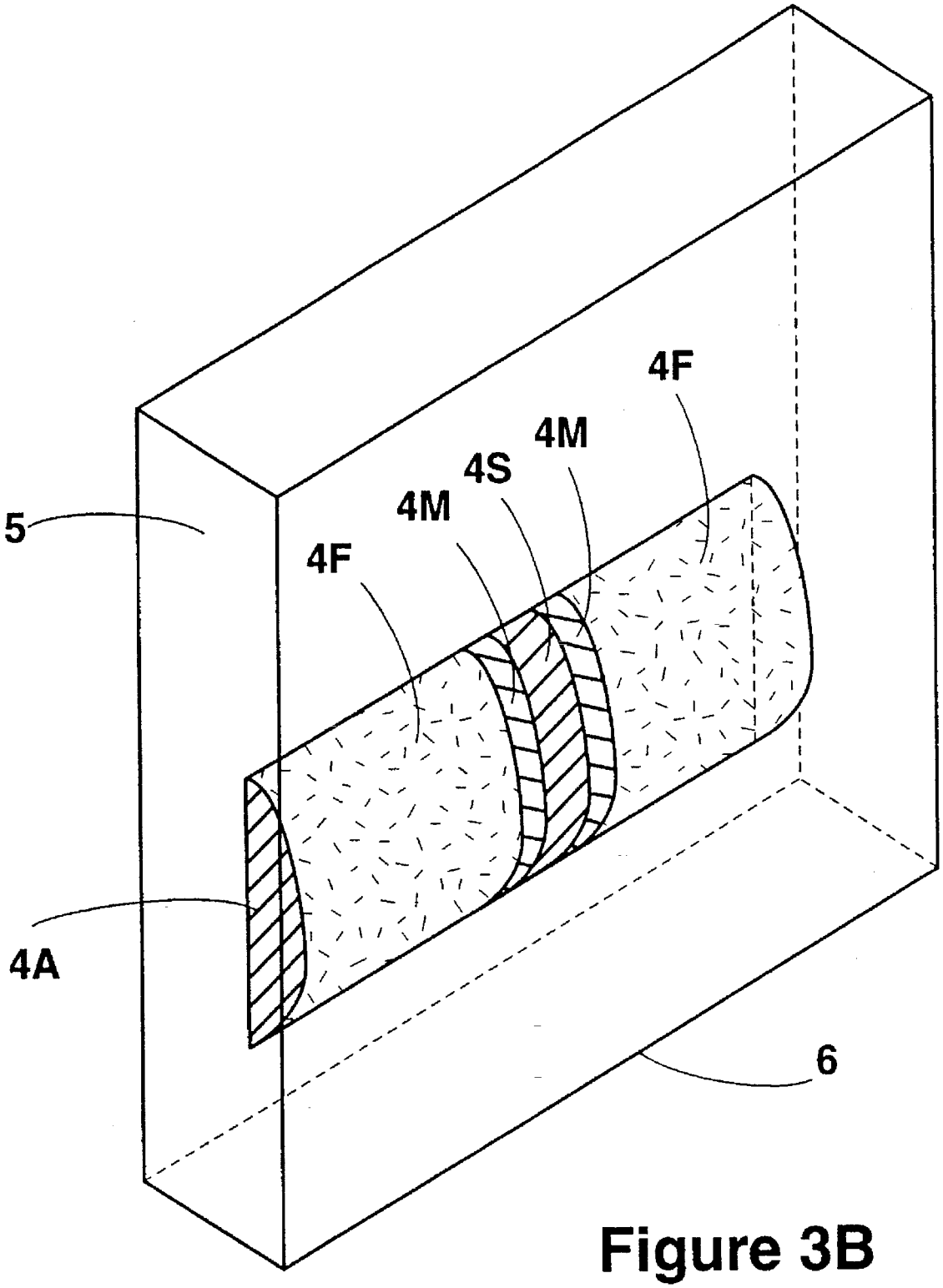
FIG. 3B is a perspective view of an embodiment similar to the one shown in FIG. 3A, but with layers of softer foam material in the center portion of the firm foam lumbar support.

FIG. 3B is a perspective view of an embodiment similar to the one shown in FIG. 3A, but with layers of softer foam material in the center portion of the firm foam lumbar support. This is similar in principle to the insert shown in FIG. 1A. The advantage of multiple layers is that they can provide a smoother transition between the very firm portion 4F of the lumbar support 4A and the softest portion of the center portion 4S by breaking it up with a medium firmness layer 4M. One way this could work is if 4F had an ILD of 50 pounds, 4M had an ILD of 40 pounds and 4S had an ILD of 30 pounds. Fabrication could be accomplished by joining blocks or layers of the appropriate foam material in the appropriate thicknesses with an adhesive, and then cutting them into the appropriate shapes.

Figure 3C:
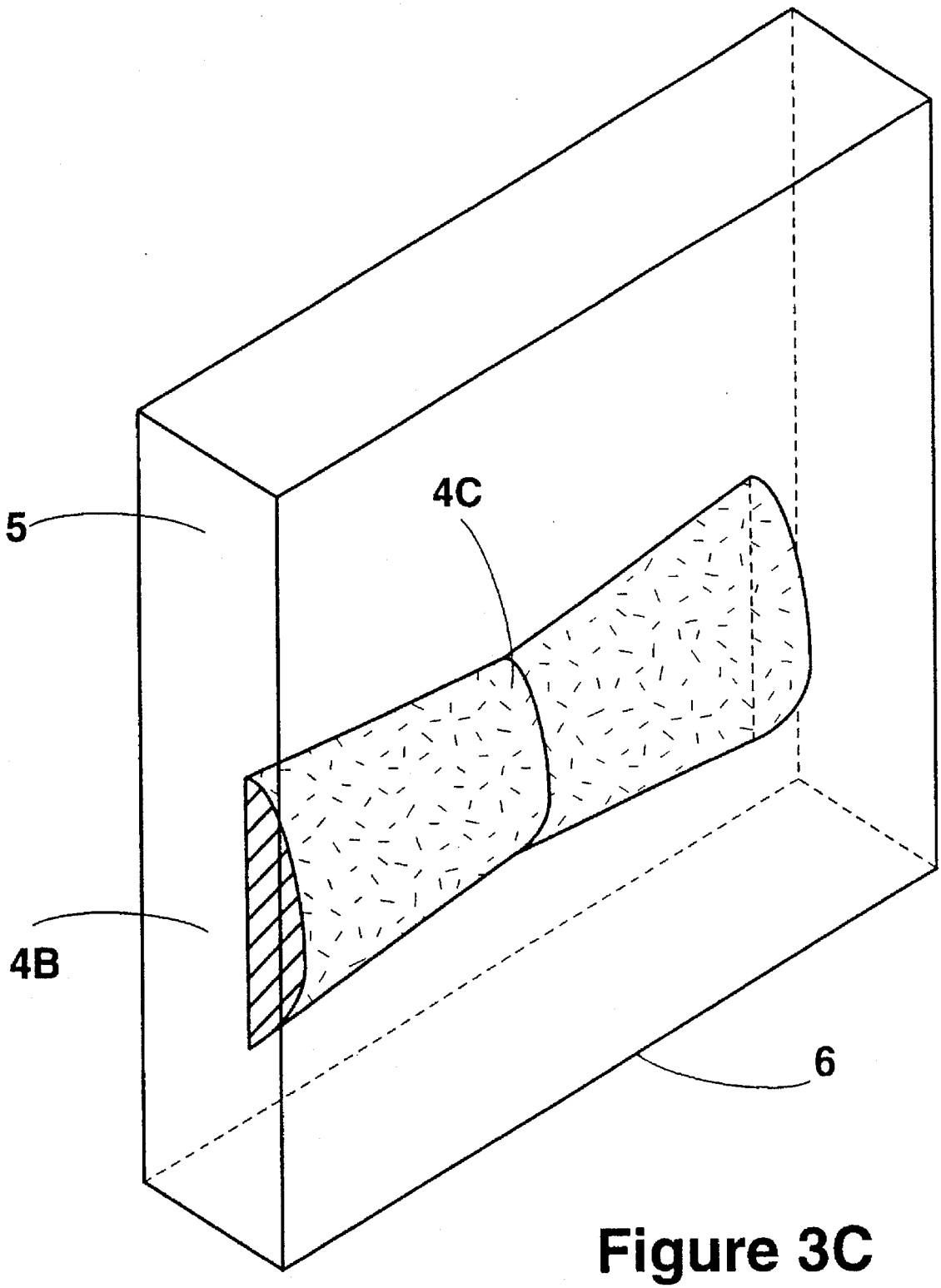
FIG. 3C is a perspective view of an embodiment similar to the one shown in FIG. 3A, but with contouring to make the center portion of the firm foam lumbar support indented somewhat.

FIG. 3C is a perspective view of an embodiment similar to the one shown in FIG. 3A, but with contouring to make the center portion 4C of the firm foam lumbar support 4B indented somewhat. In many ways this is similar to the insert described in FIG. 1B, but the shape of the contouring is somewhat different. The appropriate hollow can be fabricated using methods similar to those described in FIG. 3A, but the cutting equipment would need to be shaped appropriately.

Figure 4:
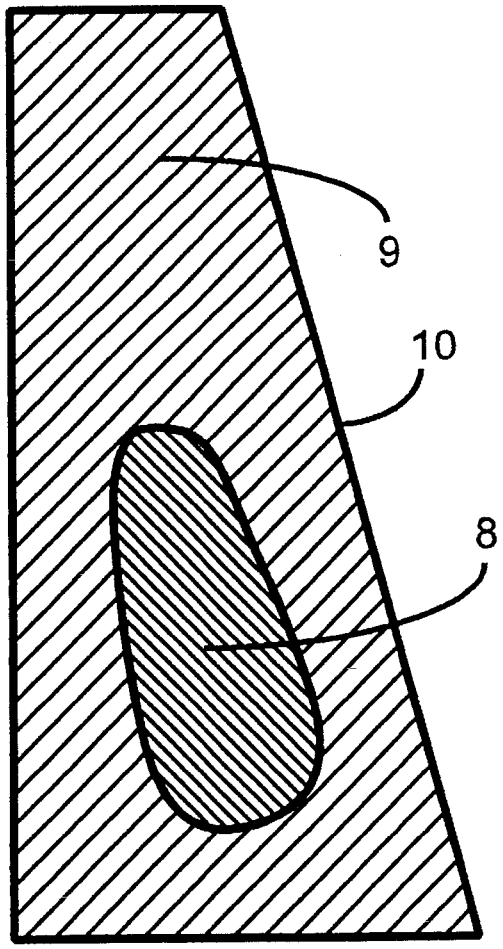
FIG. 4 is a side or cross section view of a backrest cushion, such as would be used for reading in bed, embodying the present invention.

FIG. 4 shows a side or cross section view of a typical backrest cushion, like those used for sitting up in bed, embodying the present invention. In the drawing, 8 is a firm flexible polyurethane foam oval shaped cylinder lumbar support member, 9 is a low to medium firmness flexible polyurethane foam cushion body with tubular cavity shaped like an oval cylinder, and 10 is the face or body contacting surface.

Figure 5:
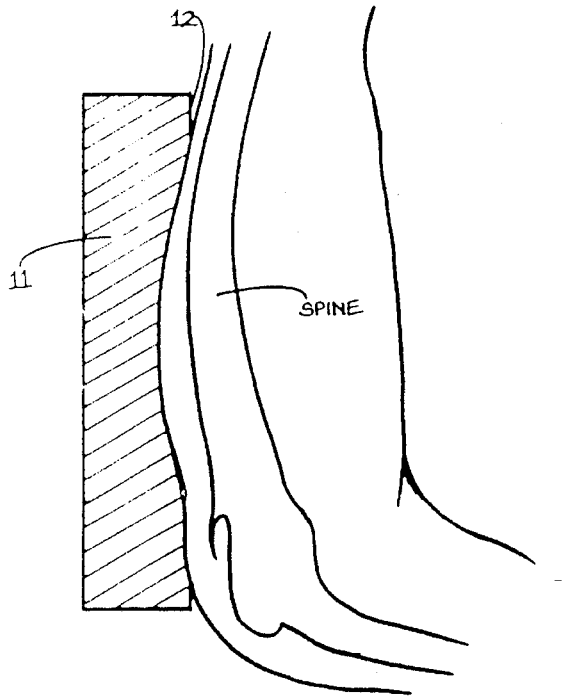
FIG. 5 is an illustration showing how a typical backrest cushion not embodying the present invention fails to provide good support, and as a result, the user's back is in an unnatural alignment.

FIG. 5 is an illustration showing how a typical backrest cushion not embodying the present invention, fails to properly support the user's back. In the drawing, 11 is a basic cushion of the prior art, 12 is the face or body contacting surface of the cushion, and next to the cushions is a view of what happens to a user's spine and body when a backrest fails to provide good lumbar support. Without the proper lumbar support, the spine is unnaturally curved, which places more stress on the back, causing fatigue and discomfort.

Figure 6:
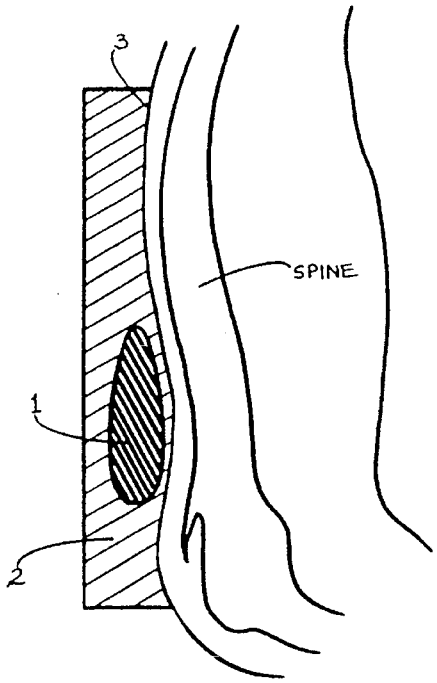
FIG. 6 is an illustration showing how a typical backrest embodying the present invention does provide good support, and as a result, the user's back is in a comfortable and more natural position.

FIG. 6 is an illustration showing how the backrest cushion, shown in FIGS. 1 and 2, embodying the present invention, does properly support the user's back. In the drawing, 1 is a high firmness flexible polyurethane foam oval cylinder lumbar support member, 2 is a low to medium firmness flexible polyurethane foam cushion body, 3 is the face or body contacting surface of the cushion, and next to the cushion is a view of what happens to a person's spine and body when they are properly supported with a cushion embodying the present invention. FIG. 6 illustrates how the natural curve of the back is maintained through use of the lumbar support. Maintaining this position reduces stress, strain, and fatigue on the spine and back muscles, making the user more comfortable for extended periods of time.

Figure 7:
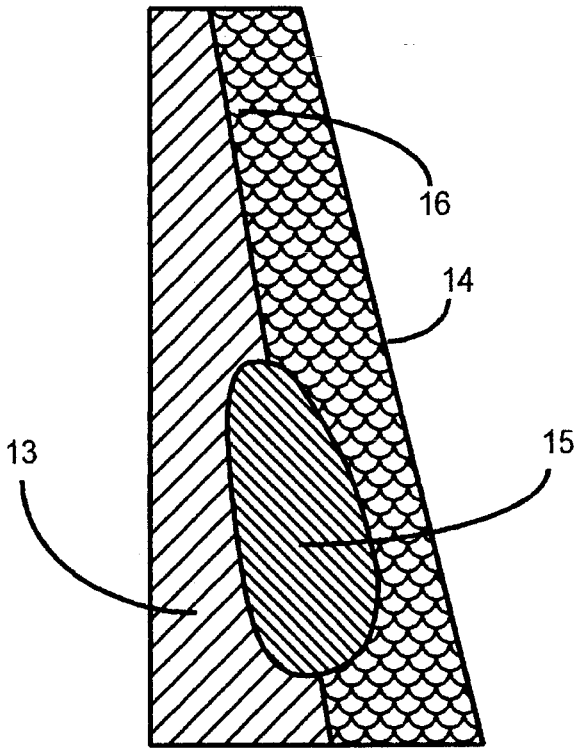
FIG. 7 is a side or cross section view of a backrest cushion embodying the present invention with loose or fiber fill material as the front or body contacting portion of the cushion.

FIG. 7 is a side or cross section view of a backrest cushion embodying the present invention with a loose fill cushioning material in the front or body contacting portion of the cushion body. In the drawing, 15 is a firm flexible polyurethane foam lumbar support member shaped like an oval cylinder, 16 is a loose or fiber fill cushioning material used as the face or body contacting portion of the cushion, 13 is a low to medium firmness flexible polyurethane foam portion of the cushion body, and 14 is the face or body contacting surface of the cushion. The polyurethane foam portion of the cushion body 13 has a horizontal, generally semi-cylindrical hollow or cavity as shown, which holds the lumbar support in place. A small amount of adhesive could be used at the areas that the lumbar support 15 and the polyurethane foam cushion body 13 contact each other. The adhesive would prevent the lumbar support member 15 from moving out of position. The loose or fiber fill material 16 could be cotton, polyester, shredded foam rubber, feathers, down, dacron, etc. Loose fill cushions can be especially soft and comfortable, but most do not provide really good support to the lumbar region. FIG. 7 shows a cushion that can be especially soft and comfortable, and at the same time it is very supportive. It may be advantageous to either enclose the soft fill material in a liner, or secure whatever covering is used to the solid polyurethane cushion body, to keep the loose fill from getting between the covering and the solid foam. For some applications, some kind of quilting means may be beneficial to keep the loose cushioning material in place, and properly distributed. Quilting means refers to using fabric to create pockets to lock the loose fill material in place in the same way down winter jackets are made to keep all the down from settling to the bottom of the jacket. Though FIG. 7 shows a backrest cushion similar to the type used for sitting up in bed, the principle can be applied to reversible, and fixed in place cushions of the type shown in FIGS. 1, 2, 3, and 4.

DESCRIPTION OF CORING TOOL/OPERATION OF CORING TOOL

Figure 8:
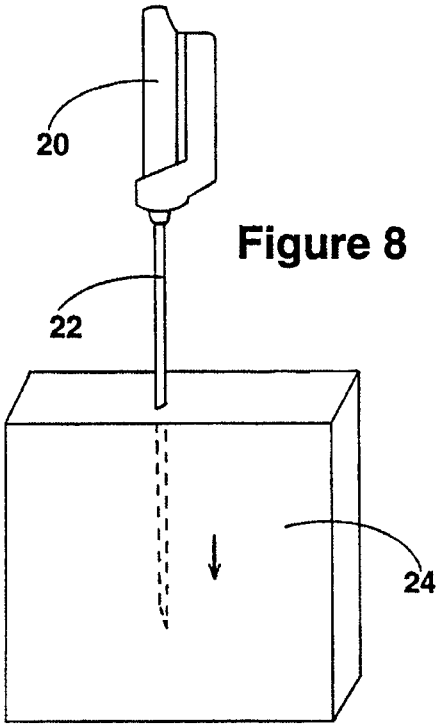
FIG. 8 is a slightly perspective view of a tool and system for removing a core from a cushion of slab polyurethane type foam. This figure shows the beginning of the process to remove a core.

FIG. 8 is a slightly perspective view of a coring tool for removing a core from a cushion of slab polyurethane foam. In the drawing, 20 is a motor that drives a pair of alternately reciprocating blades 22 to cut a core from a cushion body of slab polyurethane foam 24. The coring tool works in much the same manner as an electric knife used by families to slice meats such as ham or turkey. The major difference is that the point is sharpened, enabling it to pierce as well as cut. FIG. 8 shows the beginning of the coring process as the alternately reciprocating blades 22 are piercing the foam cushion 24. When the cushion 24 is pierced all the way through, the blades 22 will be in a position to cut the core out.

Figure 9:
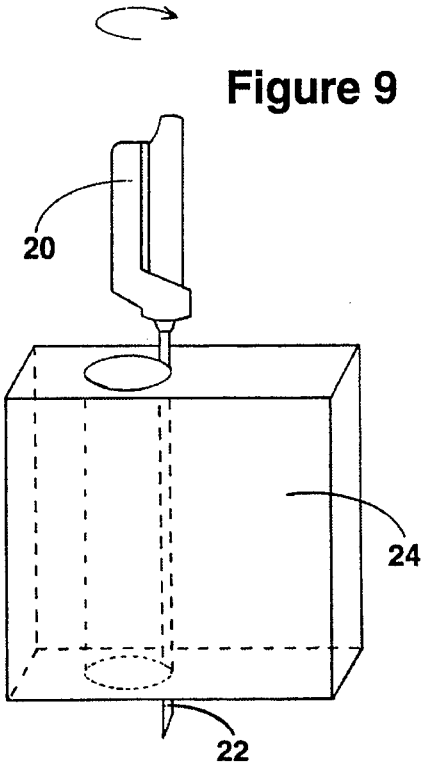
FIG. 9 is a slightly perspective view of the elements and process as shown in FIG. 8 near the completion of the cutting phase of core removal.

FIG. 9 is a slightly perspective view of the coring tool and process shown in FIG. 8, but after the piercing and cutting have been completed. In FIG. 9 the alternately reciprocating blades 22 had pierced to below the bottom of the cushion 24, and had cut the cushion in a predetermined size and shape—in this case a elliptically shaped cylinder. The direction of the cutting operation is shown above the motor for the knife 20. Though shown like a hand tool, the coring tool can be guided and automated for mass production applications.

Figure 10:
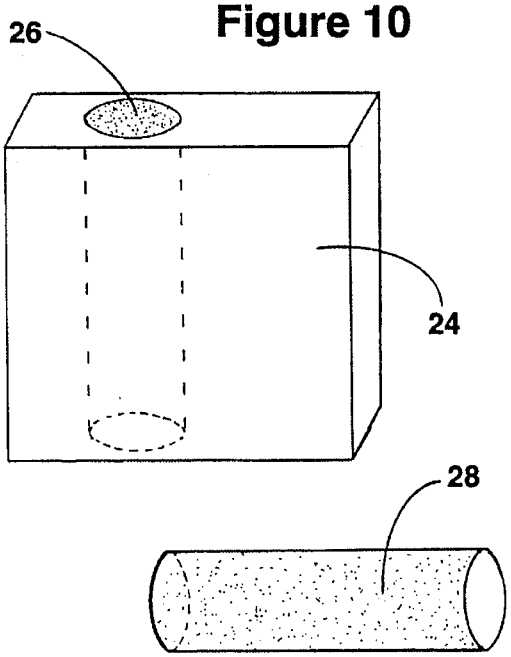
FIG. 10 is a slightly perspective view of the elements and process shown in FIG. 9 after the core has been removed.

FIG. 10 is a slightly perspective view of the cushion 24 after the coring tool shown in FIGS. 8 and 9 has been removed. Additionally, the core 28 has been removed, leaving a generally tubular cavity 26 within the cushion body 24. This tubular cavity 26 will later be filled with a cylinder of the same size and shape made of a higher firmness polyurethane foam cushion.

Figure 11:
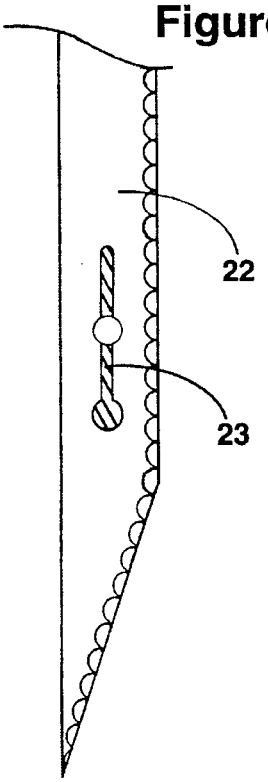
FIG. 11 is a side view of a design for the point of a cutting blade for the tool shown in FIG. 8.

FIG. 11 shows a detail of the point of the blades 22 shown in FIGS. 8 and 9. The blades 22 come to a sharp point to enable them to pierce the foam cushion. FIG. 11 also shows how the blades 22 are joined at 23, in a manner similar to a household electric knife with an interlocking post and hollow track that enable the blades to alternately move back and forth. These blades can be very similar to those in household electric knives, such as those used for cutting meats like ham or turkey.

There are other possible ways to provide a tubular cavity in cushions to insert a firm support member for the various applications, or to shape the support member. Some of the anticipated methods could include using a band saw, special routers for foam rubber, hot wire cutting tools, and using layers of cushion, instead of the single slab piece of foam as shown, to make the cavity without special knife shown. To describe how the layers of cushion could work, the body contacting layers would be plain and the middle layer(s) could be cut in a variety of ways to put a firm lumbar insert in it. It is also anticipated that for some applications, the firm foam support member may not extend the width of the cushions, and means to accomplish this are anticipated. Also, anticipated is the concept of putting a tubular cavity in a cushion that is molded in place, by using a mold that will leave a tubular cavity or hollow in the finished cushion body. These and other methods should be apparent to those knowledgeable in the art relating to this invention.

OPERATION OF INVENTION AND FURTHER DETAILS

Most cushioned chairs, sofas, backrests, etc. can be made with cushions embodying the present invention by substituting cushions embodying the present invention for the cushions not embodying the present invention. Normally, there would be no need to alter the way of making a chair, sofa, backrest, etc., though it is important that cushions be put in the right positions. Failure to properly position cushions embodying the present invention could result in problems like having the lumbar support member on a backrest cushion behind the shoulders instead of behind the lumbar region.

The size, shape, and firmness of the internal support member is dictated by the shape and/or amount of support to be directed at a particular part of the user's body, and the size (thickness), shape (planar, concave, convex, etc.), and firmness of the cushion body. For lumbar support, the internal support member would be a contoured cylinder that generally follows the curve of the lumbar region of the user's back, but depending on the characteristics of the cushion, the lumbar support could contoured to be a round, oval, teardrop shaped, elliptical or other shaped cylinder. If the cushion body was relatively soft and thin, the support member would be more elliptical, but if the cushion body were thicker and firmer, the support member would probably be thicker, and probably closer to an oval or circular cylinder. For cushions that are not reversible, the lumbar support would probably be a semi-cylinder of one of the shapes mentioned above. There is a relationship between the size, shape, and firmness of the internal support member. For example, an internal support member with an ILD of 70 lbs could provide as much support as a thicker internal support member with an ILD of 50 pounds. The size, shape, and firmness of both cushion and internal support member can be engineered for many uses and personal preferences.

An advantage of the present invention is that it can be effective with cushions of a great variety of sizes, shapes, and degrees of firmness. The size, shape, and firmness of a cushion will determine the size, shape, and firmness of the internal support member. For an example of how this can be done, consider the reversible backrest cushion of FIG. 2. If the cushion of FIG. 2 is 5" thick with an ILD (indentation load deflection on 4" at 25%) of 18 pounds, and the body contacting surface 3 is flat, then the internal support member might be a 3" thick oval cylinder with an ILD of 60 pounds. On the other hand, if the cushion in FIG. 2 is 3" with an ILD of 23 pounds and has a flat body contacting surface, then the internal support member might be 1¼" thick with an ILD of 60 pounds, and an oval shape that is a little more elliptical than for the 5" cushion.

The tubular cavity and firm foam support member are shaped, sized, and positioned to provide good support to the lumbar region of the user's body. The position could be determined based on average heights of the lumbar region for people in a country or area, or could be custom designed for one individual. In the United States, the average height for the center of the radius of the lumbar region on a seated person is about 9½ inches above the seat, so this would probably be the best height to position the widest point of the lumbar support insert.

The location of the internal support member within the cushion is determined by where the key parts of the user's body will be when the person is seated properly. For the lumbar support, it is important to take into consideration how much the person is likely to sink into the seat cushion. Failure to do so will result in a less than optimal lumbar support. The proper positions can be easily determined by someone knowledgeable in the field based on average dimensions of the human anatomy.

The angle of a cushion might also be considered when considering the size, shape, and firmness of the internal supports—especially as it gets toward a reclining position, because this causes the weight of the user to be redistributed.

As mentioned previously, one advantage of the present invention is that it makes it possible to make cushions softer, but with more support where it is needed. This is because the typical monodensity foam cushion has to be firm enough to provide minimal support to key areas such as the lumbar region of the back, but this firmness is not only in one area, it is all over. Therefore, with the present invention, it is possible to have the main cushion with an ILD lower than the typical monodensity cushion used in chairs, etc., and at the same time provide better support.

It should be pointed out, that for some applications, a small amount of adhesive may be required to secure the support member to the cushion body.

Note that a flat cushion can be made convex or concave just by putting it over a flat or concave support surface.

This invention can be used with cushions having convex, flat, concave, or contoured body contacting surfaces. The invention can also be used on cushions that are covered with a loose dacron filling or the like before upholstering. It is expected that most cushions would be mass produced to be appropriate and comfortable for most people. It is possible to make them in stock sizes to be trimmed by furniture manufacturers. However, it is critical that if a cushion is trimmed, it must be trimmed so that the internal supports will be at the right height and position when put on chairs and the like. Also, it is possible that furniture manufacturers could make the cushions themselves for each particular chair or the like that they make.

Finally, it should be pointed out that there is no perfect cushion which is "best" for everyone. Just as people have preferences on the firmness of the mattress they sleep on, it is probably also true that people have preferences on what the best cushion is to them. The above specifications provide a way of making cushions which are acceptable to many people, and can be suitable for mass production. However, it is also to be understood that the invention is suitable for people with many preferences, and the idea can be used in mass production using one standard set of specifications, or in a plurality of standard sets of specifications, or custom made to individual consumer's preferences. The basic principles of engineering cushions to specific needs are to have the cushion body and the firm internal support member work together to more evenly distribute the load of a sitting person's body, and to provide comfort and proper alignment for the user.

SEAT CUSHIONS

The present invention also relates to seat cushions, and though not specifically shown in the drawings, the same principles used with the backrest cushions can be applied to seat cushions. An internal support member could be positioned under the buttocks of the user to prevent the user from sinking down too far. For greater comfort, the buttocks support would be less convex than the lumbar support, so that the pressure from the weight of the person would not be focussed at one point. In fact, the buttocks support member would likely be flat or a little concave so that the cushion better conforms to the shape of the buttocks and thereby relatively evenly distributes the user's weight focussed at that point.

CONCLUSIONS, RAMIFICATIONS, AND SCOPE OF INVENTION

Thus the reader will see that the cushions with internal support members and the method of manufacture of this invention can be an economical way to make cushions very comfortable and supportive, can be used for cushions of many sizes and shapes, can be used with solid flexible polyurethane foam as the front or body contacting portion of the cushion or with a loose fill material as the front portion of the cushion, can be used for reversible cushions or cushions which are fixed in place, can provide a clearly defined lumbar support in backrest cushions, and can be made with polyurethane in economical slab form. Also, this invention is not just limited to use in slab foam cushions, but can be used with formed in place cushions as well.

The variations shown on various embodiments are interchangeable between embodiments. For example, multiple layers in the center portion of the firm insert shown in FIG. 3B could be used in the embodiment shown in FIG. 1A, likewise the single layer in the center of FIG. 1A can be used in the firm insert shown in FIG. 3C. Also the shape of contouring of the firm inserts can be used interchangeably between various embodiments, etc.

Although the above description contains many specificities, these should not be construed as limiting the scope of the invention, but merely as providing illustrations of some of the presently preferred embodiments of this invention. For example, the inserts themselves could be made of a multidensity elastic foam. This could be done by using an adhesive to join cushions of various density in an engineered pattern, and then cutting the insert in the shape required. And though reference was made to flexible polyurethane foam as the material used, the invention can work with any elastic foam material whether it be latex, foam rubber, or some other flexible foam material.

I claim:

1. A cushion comprising:

(a) a relatively soft generally rectangular and generally solid resilient foam cushion body having a generally planar front surface as an occupant contacting surface, the cushion body further having a transverse centerline such that about half the cushion body is above said transverse centerline and about half the cushion body lies below said transverse centerline;

said cushion body including lumbar support means therein for providing special support to the lumbar region of a user's body without distending the generally planar front surface of the cushion body; said lumbar support means comprising:

(b) a single horizontal generally tabular cavity means within the cushion body; and (c) a firmer foam support member, shaped and sized to fit in the cavity means of the cushion body, said firmer foam support member having generally convex front, the cavity means being shaped, sized and positioned to support the lumbar region of the user's back in a relatively natural lordotic lumbar curve when filled with the support member, wherein the front of the firmer foam support member is more convex than the front surface of the cushion body, with substantially all or at least 70% of the tubular cavity means and firm foam support member lying below the transverse centerline on said cushion body.

2. The cushion of claim 1 wherein the cushion body can be of shapes and sizes similar to the shapes and sizes of other generally rectangular cushions use in the furniture industry as primary cushions for chairs, sofas, backrests, etc., and wherein the generally planar front surface of the cushion body can be flat, slightly concave, or slightly convex.

3. The cushion of claim 1 wherein the support member is installed without substantially distorting the appearance of the front or rear face of the cushion body.

4. The cushion of claim 1 wherein the tubular cavity and support member are in the shape of a generally oval shaped cylinder.

5. The cushion of claim 1 wherein the cushion body has an ILD firmness of no more than 40 pounds, and the firm foam support member has an ILD firmness of at least 30 pounds, with the firm support member always having an ILD firmness greater than the cushion body.

6. The cushion of claim 1 wherein the firm foam support member has two sides and a center portion with respect to said two sides, and said center portion is comprised of one or more layers of relatively softer foam material.

7. The cushion of claim 1 wherein the wherein the firm foam support member has two sides and a center portion with respect to said two sides, and said center portion is contoured in a manner that causes it to be indented with respect to the rest of the firm foam support member.

8. The cushion of claim 1 wherein the cushion body and the support member comprises an elastic foam material.

9. The cushion of claim 1 wherein a portion of the cushion body is made of a loose fill cushioning material, and the other portion is made of an elastic foam material.

10. The cushion of claim 9 wherein the portion of the cushion body made of an elastic foam material includes said cavity means in the form of a horizontal generally semi-oval cylindrical hollow at the point that would correspond to a human user's lumbar region, with said firm foam support member being of a generally cylindrical cylindrical shape and secured in the hollow.

11. The cushion of claim 1 wherein the cushion is reversible, and the shape of the support member is not symmetric, providing different degrees of support to a key area of the user's body, depending on which side of the cushion contacts the user's body.

12. The cushion of claim 1 wherein the cushions are reversible, and the cavity in the body of the cushion and the support member are positioned more toward one face enabling the cushion to provide more support to a key area of the user's body when that side is used, and less support when the opposite side is used.

13. A cushion comprising:

(a) a relatively soft generally rectangular and generally solid resilient foam cushion body having a generally planar front surface as an occupant contacting surface, the cushion body further having a transverse centerline such that about half the cushion body is above said transverse centerline and about half the cushion body lies below said transverse centerline; said cushion body including lumbar support means therein for providing special support to a key area of a user's body without distending the generally planar front surface of the cushion body; said lumbar support means comprising;

(b) a single horizontal generally semi-cylindrically shaped hollow means on the cushion side which is opposite the generally planar front surface (c) a firm foam support member, shaped and sized to fit in the hollow means of the cushion body, said firmer foam support member having a generally convex front, the hollow means being shaped, sized, and positioned to support the lumbar region of the user's back in a relatively natural lordotic lumbar curve when filled with the support member, wherein the front of the firmer foam support member is more convex than the front surface of the cushion body, with substantially all or at least 70% of the hollow means and firm foam support member lying below the transverse centerline on said cushion body.

14. The cushion of claim 13 wherein the cushion body can be of shapes and sizes similar to the shapes and sizes of other generally rectangular cushions used in the furniture industry as primary cushions for chairs, sofas, backrests, etc., and wherein the generally planar front surface of the cushion body can be flat, slightly concave, or slightly convex.

15. The cushion of claim 13 wherein the support member is installed without substantially distorting the appearance of the front face of the cushion body.

16. The cushion of claim 13 wherein the hollow and support member are in the shape of generally oval semi-cylinder.

17. The cushion of claim 13 wherein the cushion body has an ILD firmness of no more than 40 pounds, and the firm foam support member has an ILD firmness of at least 30 pounds, with the firm support member always having an ILD firmness greater than the cushion body.

18. The cushion of claim 13 wherein the firm foam support member has two sides and a center portion with respect to said two sides, and said center portion is comprised of one or more layers of relatively softer foam material.

19. The cushion of claim 13 wherein the wherein the firm foam support member has two sides and a center portion with respect to said two sides, and said center portion is contoured in a manner that causes it to be indented with respect to the rest of the firm foam support member.

20. The cushion of claim 13 wherein the cushion body and the support member comprises an elastic foam material.

21. The cushion of claim 13 wherein a portion of the cushion body is made of a loose fill cushioning material, and another portion is made of an elastic foam material.

22. The cushion of claim 21 wherein the portion of the cushion body made of the elastic foam material includes said hollow means in the form of a horizontal contoured generally semi-cylindrical hollow at the point of the lumbar region, with said firm foam support member being of a generally cylindrical shape and secured in the semi-cylindrical hollow.

23. A cushion comprising:

(a) a relatively soft generally rectangular and generally solid resilient foam cushion body having a generally planar front face as an occupant contacting surface, the cushion body further having a transverse centerline such that about half the cushion body is above said transverse centerline and about half the cushion body lies below said transverse centerline;

(b) a firmer foam support member generally in the shape of a deformed cylinder, said firmer foam support member having a generally convex front, said generally convex front being shaped to support an occupant's lumbar region in a relatively natural lordotic curve; and (c) a single horizontal void means in the cushion body for receiving the firmer foam support member within the cushion body without distending the generally planar front face of the cushion body, the horizontal void means being shaped, sized and positioned to receive the support member in a manner that the cushion supports the occupant's lumbar region in a relatively natural lordotic curve when filled with the support member, wherein the front of the firmer foam support member is more convex than the front face of the cushion body, with substantially all or at least 70% of the horizontal void means and firm foam support member lying below the transverse centerline on said cushion body.

* * * * *